US009343791B2

(12) United States Patent
Perigaud et al.

(10) Patent No.: US 9,343,791 B2
(45) Date of Patent: May 17, 2016

(54) FREQUENCY-TUNABLE MICROWAVE-FREQUENCY WAVE FILTER WITH A DIELECTRIC RESONATOR INCLUDING AT LEAST ONE ELEMENT THAT ROTATES

(71) Applicants: THALES, Neuilly-sur-Seine (FR); CENTRE NATIONAL DE LA RECHERCHE SCIENTIFIQUE—CNRS, Paris (FR); CENTRE NATIONAL D'ETUDES SPATIALES—CNES, Paris (FR)

(72) Inventors: Aurelien Perigaud, Panazol (FR); Damien Pacaud, Beaumont sur Leze (FR); Nicolas Delhote, Limoges (FR); Olivier Tantot, Limoges (FR); Stephane Bila, Verneuil sur Vienne (FR); Serge Verdeyme, Aixe sur Vienne (FR); Laetitia Estagerie, Tournefeuille (FR)

(73) Assignees: Thales, Neuilly sur Seine (FR); Centre National de la Recherche Scientifique (CNRS), Paris (FR)

( * ) Notice: Subject to any disclaimer, the term of this patent is extended or adjusted under 35 U.S.C. 154(b) by 143 days.

(21) Appl. No.: 13/950,601

(22) Filed: Jul. 25, 2013

(65) Prior Publication Data

US 2014/0132370 A1 May 15, 2014

(30) Foreign Application Priority Data

Jul. 27, 2012 (FR) ..... 12 02128

(51) Int. Cl.

| | |
|---|---|
| ***H01P 1/20*** | (2006.01) |
| ***H01P 1/208*** | (2006.01) |
| ***H01P 7/10*** | (2006.01) |
| *H01P 7/08* | (2006.01) |

(52) U.S. Cl.

CPC ..... *H01P 1/2084* (2013.01); *H01P 1/2002* (2013.01); *H01P 1/2086* (2013.01); *H01P 7/10* (2013.01); *H01P 7/088* (2013.01)

(58) Field of Classification Search

CPC ..... H01P 1/2084; H01P 1/2086; H01P 7/10; H01P 7/105

USPC ..... 333/202, 219.1, 235

See application file for complete search history.

(56) References Cited

U.S. PATENT DOCUMENTS 4,459,570 A * 7/1984 Delaballe et al. ..... 333/202
6,147,577 A * 11/2000 Cavey ..... 333/209

(Continued)

FOREIGN PATENT DOCUMENTS

| | | | |
|---|---|---|---|
| EP | 1575118 | A1 | 9/2005 |
| JP | 5-95214 | A | 4/1993 |
| WO | 99/66585 | A2 | 12/1999 |

*Primary Examiner* — Benny Lee

(74) *Attorney, Agent, or Firm* — Baker Hostetler LLP

(57) ABSTRACT

A frequency-tunable microwave-frequency wave filter with dielectric resonator, comprises a metallic cavity and at least one stack along a rotation axis, the resonator-forming stack being disposed inside the cavity and comprising at least a first and a second element each made of dielectric material, the second element being mobile in rotation with respect to the first element around the rotation axis and exhibiting a first position and at least one second position separated by an angle of rotation, and the elements exhibiting shapes such that the overall geometry of the stack is different in the at least two positions, the stack forming a first resonator adapted so that the filter exhibits a first central frequency when the second element is in the first position, and forming a second resonator adapted so that the filter exhibits a second central frequency when the second element is in the second position.

19 Claims, 7 Drawing Sheets

(56) References Cited

U.S. PATENT DOCUMENTS

| | | | | |
|---|---|---|---|---|
| 7,705,694 | B2 | 4/2010 | Craig et al. | |
| 2002/0105394 | A1 * | 8/2002 | Barba Gea et al. | 333/202 |
| 2003/0137368 | A1 | 7/2003 | Saito et al. | |
| 2004/0051602 | A1 | 3/2004 | Pance et al. | |
| 2012/0049649 | A1 | 3/2012 | Fukunaga | |

* cited by examiner

FREQUENCY-TUNABLE MICROWAVE-FREQUENCY WAVE FILTER WITH A DIELECTRIC RESONATOR INCLUDING AT LEAST ONE ELEMENT THAT ROTATES

CROSS-REFERENCE TO RELATED APPLICATION

This application claims priority to foreign French patent application No. FR 1202128, filed on Jul. 27, 2012, the disclosure of which is incorporated by reference in its entirety.

FIELD OF THE INVENTION

The present invention relates to the field of frequency filters in the field of microwave-frequency waves, typically of frequencies lying between 1 GHz to 30 GHz. More particularly the present invention relates to frequency-tunable filters.

BACKGROUND

The processing of a microwave-frequency wave, for example received by a satellite, requires the development of specific components, allowing the propagation, the amplification, and the filtering of this wave.

For example a microwave-frequency wave received by a satellite must be amplified before being returned to the ground. This amplification is possible only by separating the set of frequencies received into channels, each corresponding to a given frequency band. The amplification is then carried out channel by channel. The separation of the channels requires the development of bandpass filters.

The development of satellites and the increased complexity of the signal processing to be performed, for example a reconfiguration of the channels in flight, has led to the need to implement frequency-tunable bandpass filters, that is to say for which it is possible to adjust the central filtering frequency which may otherwise be known as the filter tuning frequency.

One of the known technologies of tunable bandpass filters in the field of microwave-frequency waves is the use of passive semi-conducting components, such as PIN diodes, continuously variable capacitors or capacitive switches. Another technology is the use of MEMS (for micro electromechanical system) of ohmic or capacitive type.

These technologies are complex, consume electrical energy and are rather unreliable. These solutions are also limited in terms of the signal power processed. Moreover, a consequence of frequency tunability is an appreciable degradation in the performance of the filter, such as its quality factor Q.

Moreover, the technology of filters with dielectric resonator is known. It makes it possible to produce non-tunable bandpass filters.

FIG. 1 describes an exemplary non-tunable microwave-frequency wave filter with a dielectric resonator.

An input excitation element 10 introduces the wave into the cavity (input port), this element is typically a conducting medium such as a coaxial cable or a waveguide.

The cavity 13 is a closed cavity consisting of metal, typically aluminum or a metal alloy such as Invar.

An output excitation element 11, typically a conducting medium such as a coaxial cable or a waveguide, makes it possible for the wave to exit the cavity (output port).

The resonator 12 consists of a dielectric element of arbitrary shape, typically round or square, and disposed inside the metallic cavity 13. The dielectric material is typically zirconia, alumina or barium magnesium tantaate ("BMT").

From an electromagnetic point of view, a resonator is characterized by its resonant frequency, for which a steady, periodic vibration of the electromagnetic field is established.

A bandpass filter allows the propagation of a wave over a certain frequency span and attenuates this wave for the other frequencies. A passband and a central frequency of the filter are thus defined. For frequencies around its central frequency, a bandpass filter exhibits high transmission and low reflection.

A filter comprises at least one resonator, coupled to the ports of the filter, input port and output port.

In order to increase their selectivity, that is to say their capacity to attenuate the signal outside of the passband, these filters can be composed of a plurality of resonators coupled together.

The central frequency and the passband of the filter depend at one and the same time on the individual resonators and on their respective at least one resonant frequency, and on the coupling together of the resonators as well as the couplings to the ports of the filters.

Coupling means are for example openings or slots which may otherwise be known as irises, electrical or magnetic probes or microwave-frequency lines.

The passband of the filter is characterized in various ways according to the nature of the filter.

The parameter S is a parameter which expresses the performance of the filter in terms of reflection and transmission. By numbering the two access ports 1 and 2, S11 corresponds to a measurement of the reflection and S12 or S21 to a measurement of the transmission, respectively.

A filter carries out a filtering function. This function can generally be approximated via mathematical models (iterative functions such as Chebychev, Bessel, functions etc.). These functions are generally based on ratios of polynomials:

For a filter carrying out a filtering function of Chebychev or generalized Chebychev type, the passband of the filter is determined at equi-ripple of S11 (or S22), for example at 15 dB or 20 dB of reduction in the reflection with respect to a frequency that is not within a range of the passband of the filter. For a filter carrying out a function of Bessel type, the frequency band corresponding to a bandwidth of −3 dB (when S21 crosses S11) is determined to be the passband.

FIG. 2 describes an exemplary filter 13 with three resonators 23, 24, 25 coupled together and situated inside 3 cavities coupled through coupling irises. Conducting separation walls 26, 27 separate the resonators, and the coupling irises or openings 21 and 22 couple the resonators together. An input excitation element 10 may introduce a wave into the filter, and an output excitation element 11 may make it possible for the wave to exit the filter 13.

A characteristic example of frequency response (parameters S11 and S12) of a filter is illustrated in FIG. 3. The curve 31 corresponds to the reflection S11 of the wave on the filter as a function of its frequency (f) measured in GHz. The equi-ripple passband at 20 dB (which is marked along the axis dB in the graph of FIG. 3) of reflection is noted with numeral 36. The filter exhibits a central frequency (fc) corresponding to the frequency of the middle of the passband. The curve 32 of FIG. 3 describes the corresponding transmission S12 of the filter as a function of frequency.

The tuning of the filter making it possible to obtain a transmission maxima (reflection minima) for a given frequency band may be a very complicated process and depends on the set of parameters of the filter. It is moreover dependent on temperature and environmental conditions in general.

In order to perform an adjustment of the filter to obtain a precise central frequency of the filter, the resonant frequencies of the resonators of the filter can be very slightly modified with the aid of metallic screws, but this method performed in an empirical manner, is very expensive time-wise and allows only very weak frequency tunability, typically of the order of a few %. In this case, the objective is not tunability but the obtaining of a precise value of the central frequency; and it is desired to obtain a reduced sensitivity of the frequency of each resonator in relation to the depth of the screw.

The circular or square symmetry of the resonators simplifies the design of the filter and the selection of the mode (TE for Transverse Electric or TM for Transverse Magnetic) which propagates in the filter.

U.S. Pat. No. 7,705,694 describes a passband-tunable filter composed of a plurality of dielectric resonators coupled together, of radially non-uniform shape and uniform along an axis z perpendicular to the direction of propagation. Each resonator is able to perform a rotation about the axis z between two positions, which induces a change in the value of the width of the passband, typically from 51 Mhz to 68 Mhz. This device allows tunability as regards the value of the width of the passband of the filter, but not as regards its central frequency.

SUMMARY OF THE INVENTION

The aim of the present invention is to produce filters that are tunable in terms of central frequency which do not exhibit the aforementioned drawbacks.

For this purpose, the subject of the invention is a frequency-tunable microwave-frequency wave filter with dielectric resonator, comprising a metallic cavity and at least one stack of elements, for example a stack of dielectric elements along a rotation axis, the resonator-forming stack being disposed inside the cavity and comprising at least one first element made of dielectric material and at least one second element made of dielectric material, the second element being mobile in rotation with respect to the first element around the rotation axis (x) and exhibiting a first position (p1) and at least one second position (p2) separated by an angle of rotation, and the elements exhibiting shapes such that the overall geometry of the stack is different in the at least two positions, the stack forming a first resonator adapted so that the filter exhibits a first central frequency when the second element is in the first position, and forming a second resonator adapted so that the filter exhibits a second central frequency when the second element is in the second position.

Advantageously, the filter furthermore comprises rotation control means for the second element.

Advantageously, the second element has a substantially plate shape in a plane perpendicular to the rotation axis x.

According to one embodiment, the second element comprises an axis of symmetry S disposed in a plane perpendicular to the rotation axis x.

Advantageously, the axis of symmetry s passes through the rotation axis x.

Advantageously, the second element has the shape of an oval plate.

Advantageously, the first element is substantially identical to the second element.

Advantageously, the first position of the second element is such that the first and second elements are exactly superimposed.

Advantageously, the angle of rotation is substantially equal to 90°.

The stack can comprise a third element substantially identical to the first element and exactly superimposed, the second element being positioned between the first and the third element.

According to one embodiment, the stack comprises a plurality of substantially identical mobile elements.

The plurality of mobile elements can exhibit one and the same first position and one and the same second position.

According to one embodiment, the filter comprises a plurality of stacks according to a plurality of rotation axes, forming a plurality of first resonators coupled together so that the filter exhibits a first central frequency, and forming a plurality of second resonators coupled together so that the filter exhibits a second central frequency.

Advantageously, the stacks are identical.

Advantageously, the rotation axes are aligned.

According to one embodiment the first position and/or the at least second positions are variable as a function of temperature so as to maintain the values of the central frequencies constant during a temperature variation.

There is also proposed, according to another aspect of the invention, a microwave-frequency circuit comprising at least one filter according to the invention.

BRIEF DESCRIPTION OF THE DRAWINGS

Other characteristics, aims and advantages of the present invention will become apparent on reading the detailed description which follows with regard to the appended drawings given by way of nonlimiting examples and in which.

DETAILED DESCRIPTION OF THE PREFERRED EMBODIMENTS

The invention consists in producing a filter that is tunable in terms of central frequency by modifying the shape of at least one dielectric resonator, carried out with the aid of a rotation of stacked dielectric elements. The filter according to the invention is a bandpass filter characterized by a central frequency and a passband.

Figure 1:
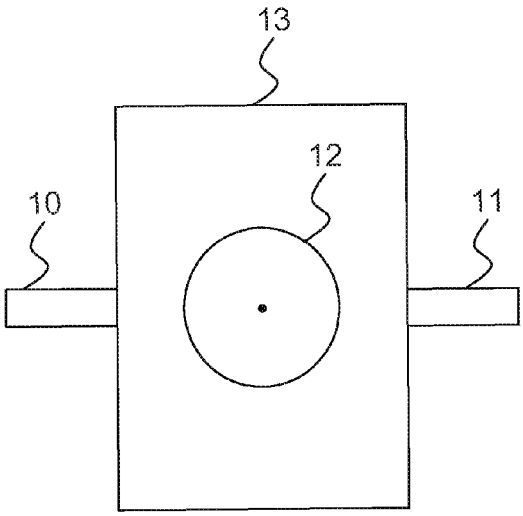
PRIOR ART Fig. 1
FIG. 1 illustrates an exemplary filter with dielectric resonator according to the prior art comprising a resonator.
Figure 2:
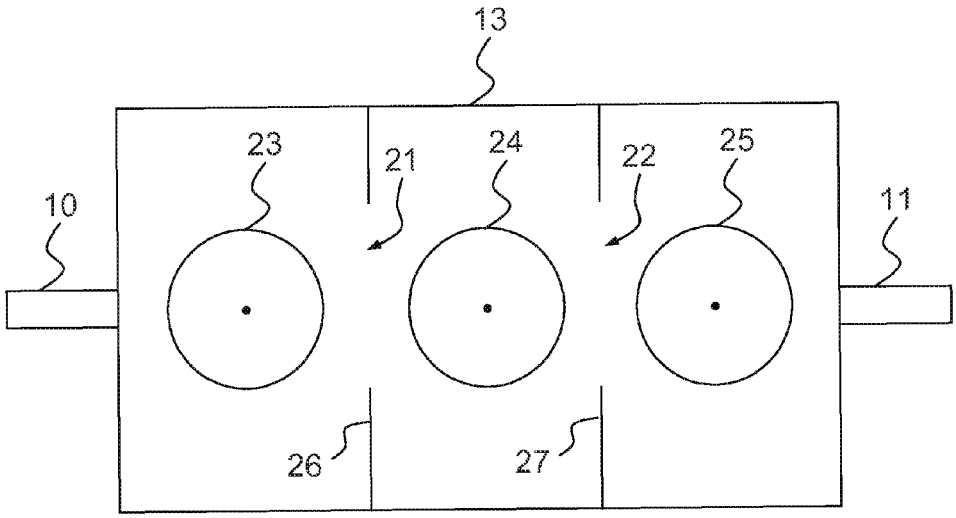
PRIOR ART Fig. 2
FIG. 2 illustrates an exemplary filter with dielectric resonator according to the prior art comprising a plurality of resonators.
Figure 3:
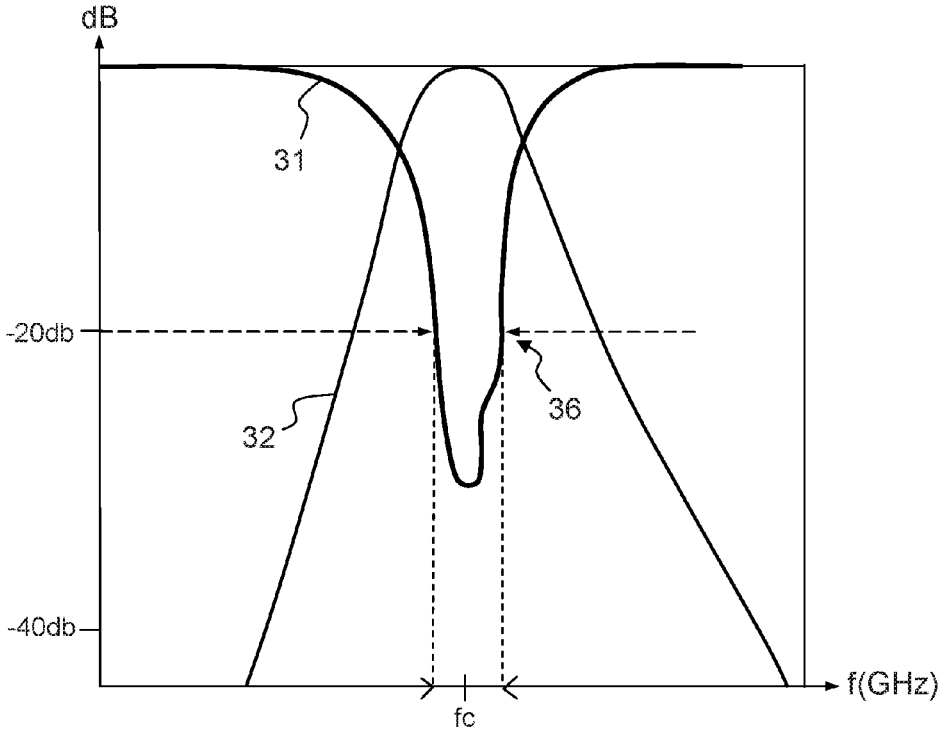
PRIOR ART Fig. 3
FIG. 3 describes the transmission and reflection curve of the filter described in FIG. 2.
Figure 4:
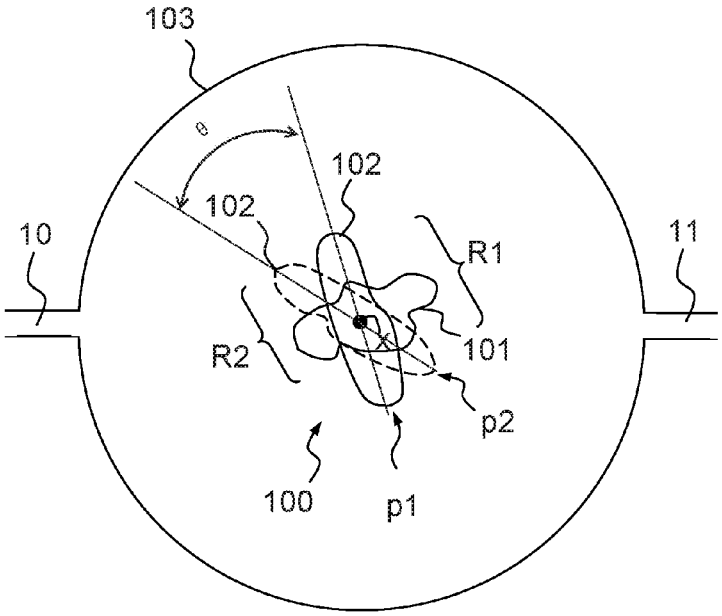
FIG. 4 describes an exemplary frequency-tunable dielectric resonator filter according to one aspect of the invention.

FIG. 4 describes a frequency-tunable dielectric resonator filter for a microwave-frequency wave according to the invention.

The filter comprises a closed metallic cavity 103. The microwave-frequency wave enters the cavity with the aid of input excitation elements 10 and emerges therefrom with the aid of an output excitation element 11. The filter also comprises at least one stack 100 of elements made of dielectric material forming a resonator disposed inside the cavity 103. The stack of elements 100 is positioned along an axis, which is a rotation axis designated as "x" in FIG. 4, and which extends perpendicular to a plane extending parallel to a direction along with a input excitation element 10 and an output excitation element 11 extend in FIG. 4 (i.e. rotation axis x extends "through the page" of FIG. 4).

The resonator according to the invention concentrates the electric field of the microwave-frequency wave in the dielectric stack 100 or in its close vicinity. On account of its concentration in the dielectric element, the electric field is hardly present at the level of surfaces of the cavity 103, thereby making it possible to minimize metallic losses.

The cavity 103 guarantees the insulation or shielding of the resonator with respect to the outside and its geometry also contributes, to a lesser extent than the dielectric stack, to the establishment of a resonance in the cavity 103.

The stack 100 comprises at least one first element 101 made of dielectric material and at least one second element 102 made of dielectric material. The dielectric materials of the first and of the second element can be different. The dielectric material comprises for example alumina, zirconia, BMT, etc.

The second element 102 is mobile in rotation with respect to the first element 101 around a rotation axis x. The dielectric elements 101 and 102 are not in mechanical contact.

The second element exhibits a first position p1 and at least one second position p2 corresponding to a rotation by an angle theta (8) around the rotation axis x of the second element 102 with respect to the first position p1. The shapes of the first and of the second element are such that the overall geometry of the stack 100 is different in the two positions p1 and p2.

Overall geometry is intended to mean the overall shape of the outside envelope of the stack.

The two shapes obtained for the two positions are such that, in combination with the geometry of the cavity, the assembly constitutes a bandpass filter for each of the two positions. The shapes of the resonators are optimized in such a way that the filter exhibits the values of central frequencies sought, the best quality factors and the couplings (resonator/resonator or resonator/port) that are appropriate for producing the desired filter.

These shapes can be obtained for example via shape optimization algorithms or iterations of "cut and try" type. The shape of the cavity can also form part of the optimization process.

Particular attention is paid to the modification of this performance when the mobile element or elements of the resonator perform a rotation. Indeed, if the fields modify one another, and for example stretch, for a given mode as a function of the rotation of the mobile pieces (thereby causing the desired change of frequency of the resonator), there may be a corresponding effect on the quality factor and the couplings. One then seeks to maximize the impact on frequency and minimize the impact on the quality factor, all this while controlling the law of variation of the coupling (or couplings) according to rotation. These various constraints guide the obtaining of the shape of the resonator, its positioning in the cavity and the creation of the inter-resonator couplings.

A Transverse Electric ("TE") mode is chosen in a preferential but nonlimiting manner for its performance in terms of quality factor. Indeed, a modification of the field, which accompanies the rotation of the dielectric elements, is an excellent means of changing the frequency of this mode with a weak variation in the quality factor of the resonator.

When the second element 102 is in the first position p1, the stack 100 forms a first resonator R1 and the filter exhibits a first central frequency fc1. When the second element 102 is in a second position p2 from among at least one possible, the stack 100 forms a second resonator R2 and the filter exhibits a second central frequency fc2.

Thus, the filter can be frequency-tuned by change of position of the second element 102 from p1 to p2. One thus passes from a filter of central frequency fc1 to a filter of central frequency fc2 by rotating the second element 102 with respect to the first element 101 around the rotation axis x. This change of frequency is may otherwise be known as channel hopping.

According to a variant the second element 102 exhibits a plurality of positions, corresponding to various angles, for which the stack obtained forms respectively a plurality of resonators, allowing the obtaining of a filter tunable over a plurality of central frequencies.

An advantage of the filter according to one aspect of the invention consists of frequency tunability while preserving good properties at quality factor Q level.

Furthermore, such a tunable filter has good power handling.

Another advantage is modest cost of fabrication, on account of the use of known technology which utilizes bricks of dielectric material ("dielectric bricks") for filters with dielectric resonators.

According to one embodiment, the change of position of the second element 102 is performed manually by an operator. This is for example the case for a generic filter, fabricated in advance in several copies, and adjusted manually on request, thereby making it possible to reduce fabrication costs and delivery timescales.

According to another embodiment, the change of position of the second element 102 is performed with the aid of rotation control means, such as a motor. The advantage is that the control of the channel hopping is performed remotely, without any operator, this being necessary when the channel hopping must take place aboard a satellite in orbit (in-flight reconfiguration).

The shape of the second element can be optimized according to several variants.

According to a variant the second element 102 has a substantially plate shape in a plane perpendicular to the rotation axis x. The rotation of the second element 102 is facilitated.

Figure 5:
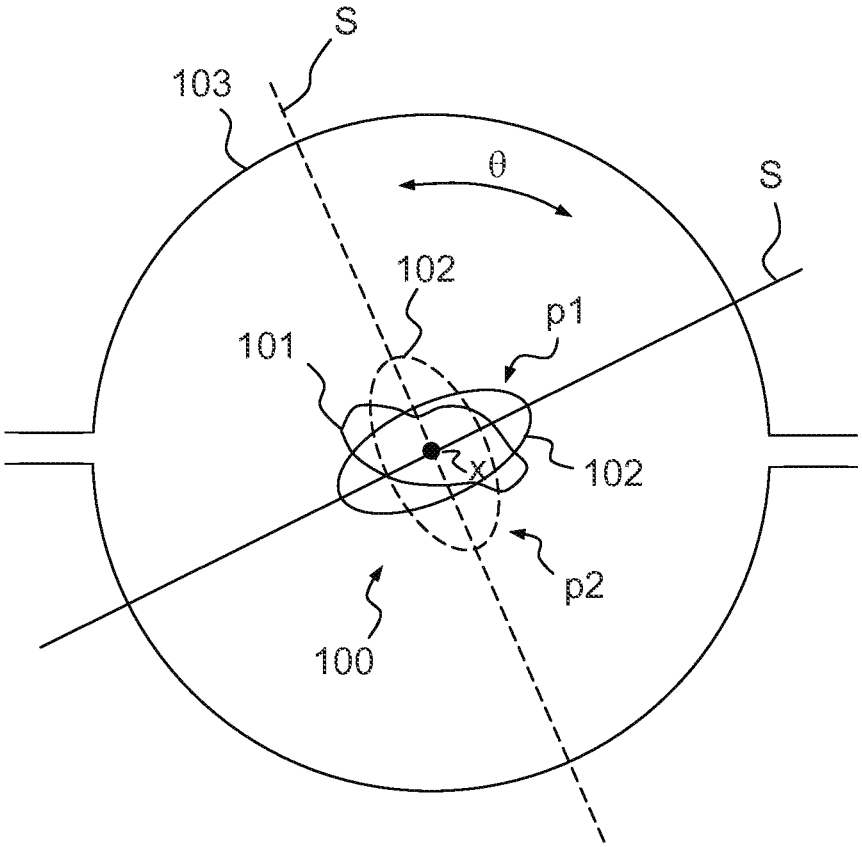
FIG. 5 describes a variant of the filter according to one aspect of the invention.

According to a variant described in FIG. 5 the second element 102 of the at least one stack 100 disposed inside the cavity 103 exhibits a shape comprising an axis of symmetry S disposed in a plane perpendicular to the rotation axis x. Thus, the fabrication of the second element 102 is simplified. The second element exhibits the first position p1 and at least one second position p2 corresponding to a rotation by an angle theta (8) around the rotation axis x of the second element 102 with respect to the first position p1. The shapes of the first and of the second element are such that the overall geometry of the stack 100 is different in the two positions p1 and p2.

According to a variant also described in FIG. 5, the axis of symmetry S passes through the rotation axis x. Thus the control of the rotation is simplified.

According to a variant also described in FIG. 5, the second element has the shape of an oval plate. Thus the fabrication is facilitated, at low cost. Moreover, the simulations for calculating the resonant filter are simplified, on account of symmetry.

According to another variant, the first element 101 has a shape identical to the shape of the second element 102. Thus the cost of fabrication is decreased.

Another variant is described in FIGS. 6A-6F, the stack being seen from above. The stack consists of two identical circular annular elements 61 and 62 (FIGS. 6A-6C) positioned about a rotation axis x. An input excitation element 10 (FIG. 6A) may introduce a wave into the cavity 103, and an output excitation element 11 (FIG. 6A) may make it possible for the wave to exit the cavity 103. In this example, the diameter of the cavity 103 (FIG. 6A) is 17 mm, the diameter of the annular elements 61 and 62 is 8.5 mm. Each element has a thickness along the rotation axis x of 2.5 mm, for a total cavity height of 15 mm.

In a first position p1 (FIG. 6A), the two elements are exactly superimposed. The mobile element 62 is able to perform a rotation about the rotation axis x off-centred with respect to the centre of the circular elements. The mechanical supports are not represented. In a second position p2 described in FIG. 6B the mobile element 62 has performed a rotation by an angle of theta2 (θ2) around the rotation axis x, and in a third position p3 described in FIG. 6C the mobile element 62 has performed a rotation by an angle of theta3 (θ3) around the rotation axis x.

Figure 6A:
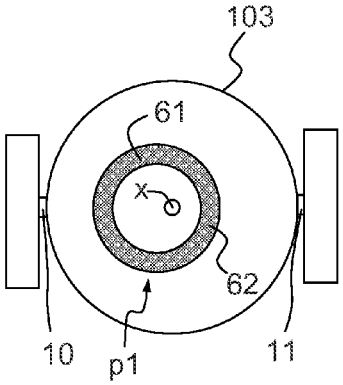
FIGS. 6A-6F describes an exemplary embodiment of a filter according to the invention exhibiting two annular dielectric elements.
Figure 6D:
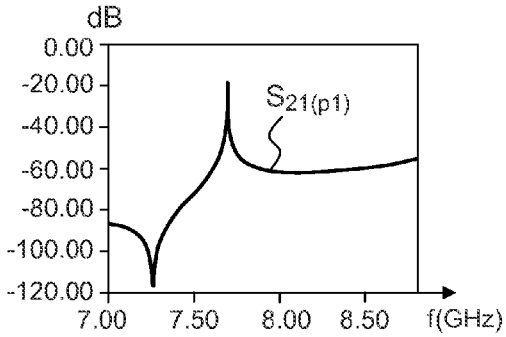
Figure 6B:
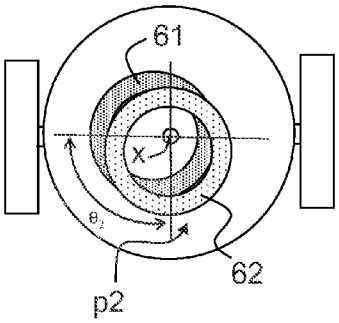
Figure 6E:
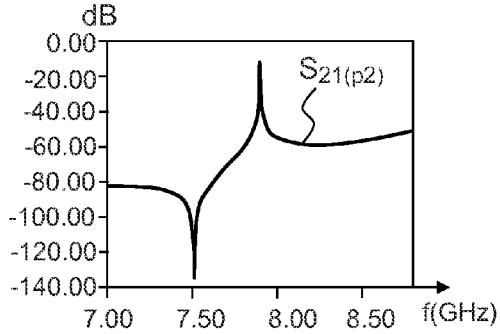
Figure 6C:
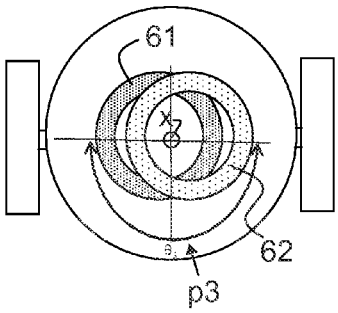
Figure 6F:
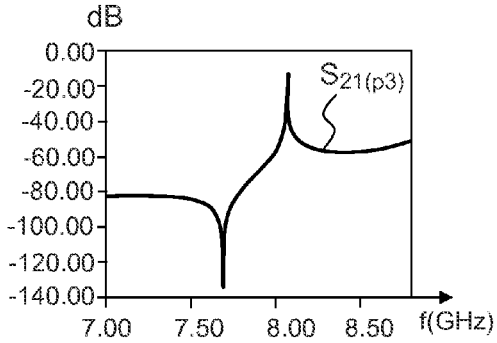

FIGS. 6D to 6F illustrate the transmission S21 measured in dB, of the filter in TE mode, FIG. 6D corresponding to the transmission of the filter when the mobile element 62 is in the first position p1, FIG. 6E corresponding to the transmission of the filter when the mobile element 62 is in the second position p2, FIG. 6F corresponding to the transmission of the filter when the mobile element 62 is in the third position p3. Noted on these curves is a modification of the central frequency (fc) measured in GHz of the frequency passband of the filter as a function of the position of the mobile element 62.

Figure 7A:
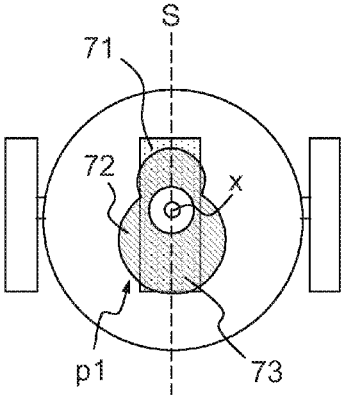
FIGS. 7A-7D describes an exemplary embodiment of a filter according to the invention exhibiting three dielectric elements one of which is mobile, the two fixed elements being rectangular.
Figure 7C:
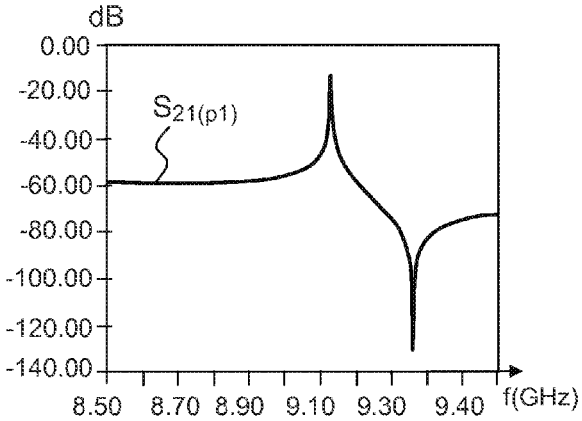
Figure 7B:
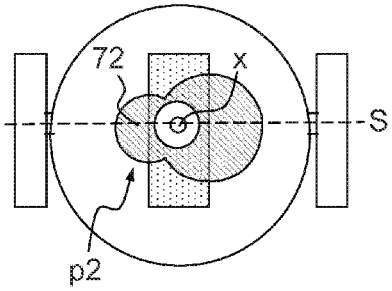

According to one embodiment such as described in FIG. 7A, the stack comprises a third element 73 of the same shape as the first element 71 and exactly superimposed. In the example of FIG. 7A the two fixed elements 71 and 73 are of rectangular shape positioned along a rotation axis x. The second mobile element 72 illustrated in FIGS. 7A and 7B is positioned between the first and the third element along the rotation axis x.

The diameter of the cavity is in this example 17 mm and its height along the rotation axis x is 15 mm.

The mobile element 72 has a length of 10 mm along its axis of symmetry S in the plane perpendicular to the rotation axis x. Each element has a height of about 1.3 mm along the rotation axis x.

Figure 7D:
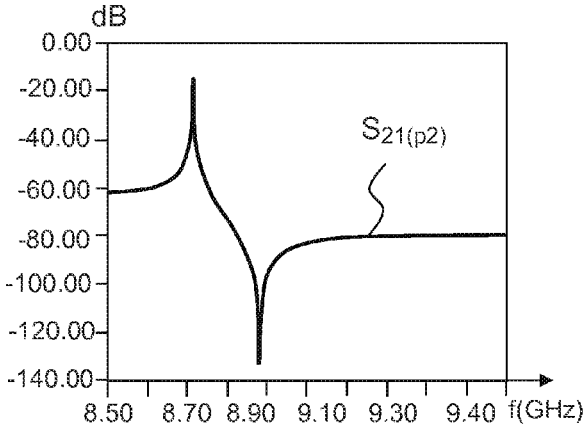

For the mobile element in a first position p1, described in FIG. 7A, the filter exhibits a transmission S21(*p*1) measured in dB (FIG. 7C), for the mobile element in a second position p2 (FIG. 7B), corresponding to an angle of rotation of 90°, the filter exhibits a transmission S21(*p*2) measured in dB (FIG. 7D). Noted on these curves is a modification of the central frequency (fc) measured in GHz of the frequency passband of the filter as a function of the position of the mobile element 72, as shown in FIGS. 7A and 7B.

With a third element in the stack, a larger choice of possible shapes for the resonators R1 and R2 is obtained.

An angle of rotation between the first position p1 and a second position p2 substantially equal to 90° allows maximum stretching of the electric field.

According to a variant, the stack comprises a plurality of mobile elements all exhibiting an identical shape. Thus the cost of fabrication is decreased while allowing a larger choice of possible shapes for the resonators.

According to one embodiment of this variant, the mobile elements exhibit one and the same first position p1 and one and the same second position p2. The simulations for calculating the resonant filter are simplified, on account of the greater symmetry of shape of the resonators R1 and R2.

According to a preferred variant of the invention discussed in more detail below with reference to FIGS. 8A, 8B, 9A, and 9B, the filter comprises a plurality of stacks, indexed by the index i, Ei, each stack Ei being along a rotation axis xi. Each stack Ei forms a first resonator R1*i* in a first position p1*i* and a second resonator R2*i* in a second position p2*i*. The resonators are coupled together by coupling means, such as for example openings in the separation between two successive resonators.

The filter comprising the plurality of resonators R1*i* exhibits a central frequency fc1, and the filter comprising the plurality of resonators R2*i* exhibits a central frequency fc2 different from fc1.

An advantage of this variant is greater selectivity of the filter, so as to obtain a more significant rejection of the signal from the signal whose frequency is outside of its passband.

According to one embodiment, all the stacks are identical. Thus the fabrication of the filter is thus simplified and its cost is decreased.

Figure 8A:
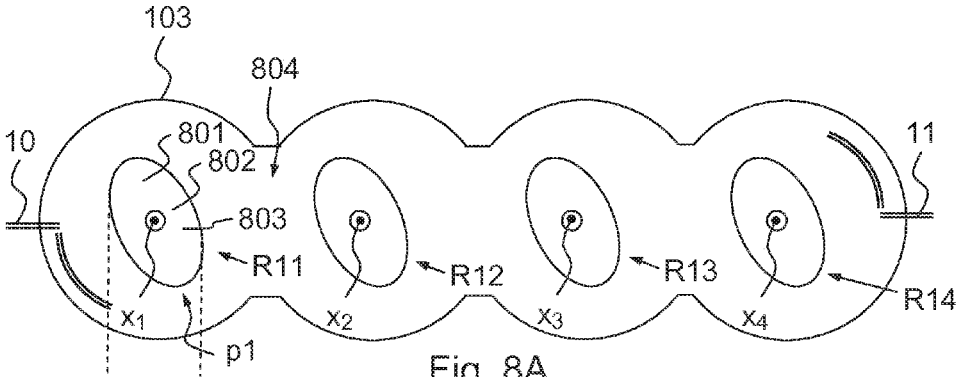
FIGS. 8A and 8B describes an exemplary filter according to the invention comprising a plurality of stacks with the mobile element in a first position.
Figure 8B:
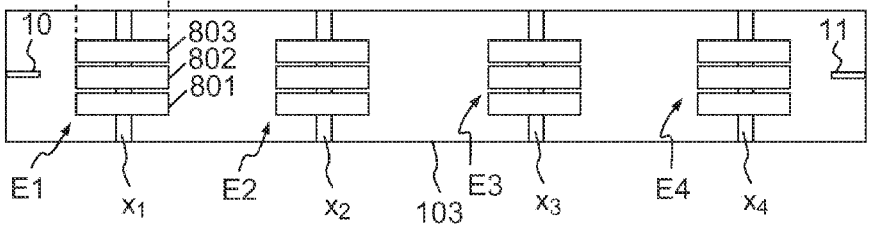
Figure 9A:
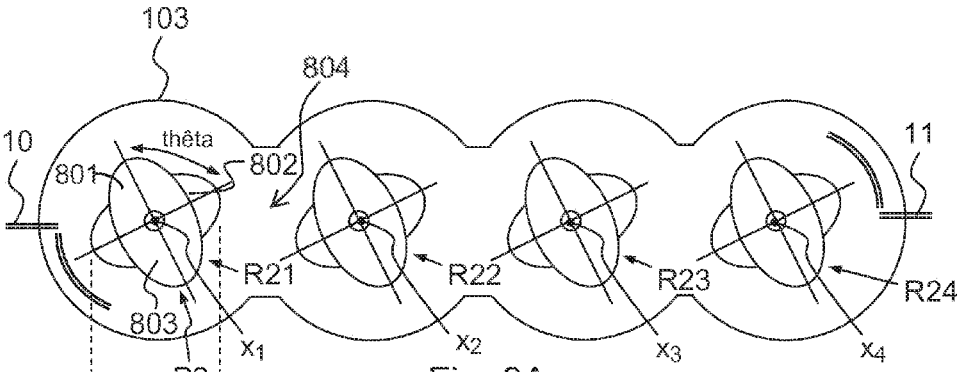
FIGS. 9A and 9B describes the same example as that described in FIGS. 8A and 8B, with the mobile element in a second position.
Figure 9B:
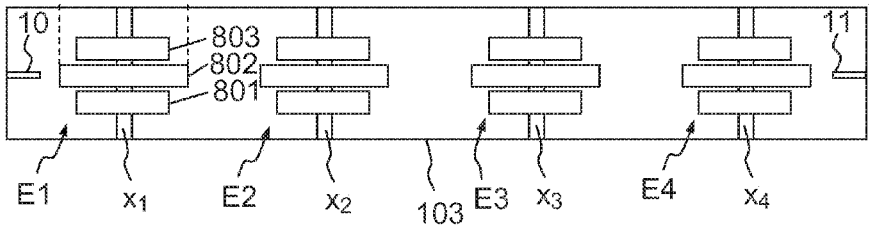

According to one embodiment, the axes of rotation xi are aligned in parallel as illustrated in FIGS. 8B and 9B described in more detail below. Thus the assemblage and the adjustments of the filter are simplified.

FIGS. 8A, 8B, 9A, and 9B describe an exemplary filter according to the preferred variant of the invention. The filter comprises 4 identical stacks E1, E2, E3 and E4 (FIGS. 8B and 9B) along 4 rotation axes x1, x2, x3 and x4. An input excitation element 10 introduces the wave into the cavity 103. The cavity 103 is a metallic closed cavity, consisting of a plurality of mutually coupled cavities.

An output excitation element 11 makes it possible for the wave to exit the cavity.

FIGS. 8A and 8B represents the filter with the second element in a first position p1 (FIG. 8A), FIGS. 9A and 9B represents the filter with the second element in a second position p2 (FIG. 9A).

The elementary stack is composed of three dielectric elements which are identical oval plates. The second mobile element 802 is disposed between a first element 801 and a third element 803.

FIG. 8A describes the filter seen from above and FIG. 8B the filter seen in profile. In the first position p1, identical for all the stacks, the three plates are exactly superimposed, forming four identical resonators R11, R12, R13 and R14, as shown in FIG. 8A. The resonators are linked together by coupling means 804 as shown in FIG. 8A.

FIG. 9A describes the filter seen from above and FIG. 9B the filter seen in profile. In the second position p2, identical for all the stacks, the second element 802 is rotated by an angle theta (θ) of 90° with respect to the first element 801 and to the third element 803, forming four identical resonators R21, R22, R23 and R24, as shown in FIG. 9A. The resonators are linked together by coupling means 804 as shown in FIG. 9A.

Figure 10:
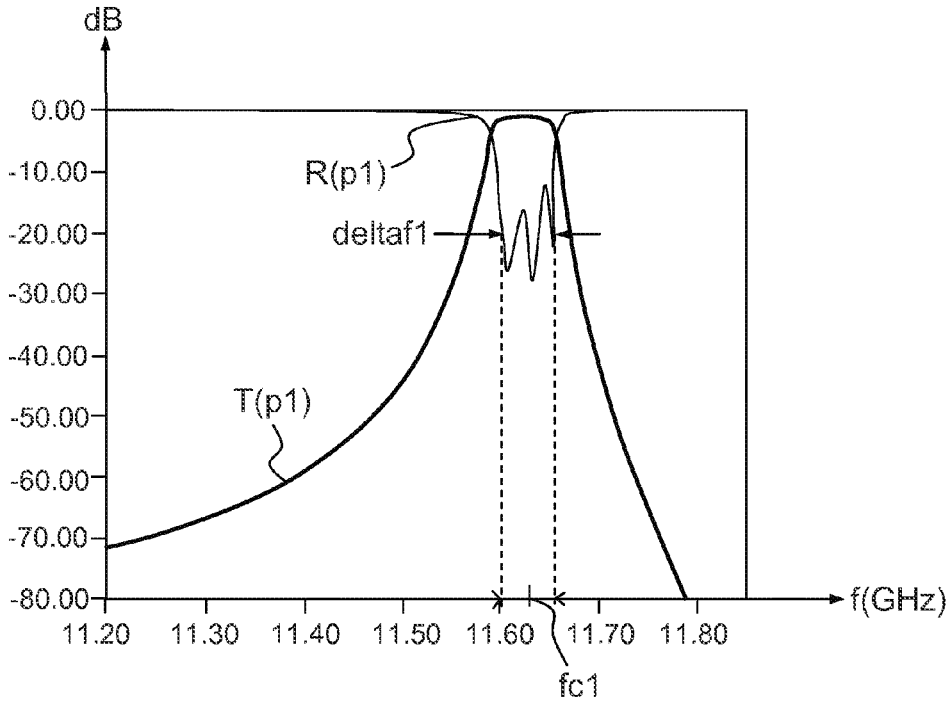
FIG. 10 represents the reflection and transmission curves of the filter described in FIGS. 8A and 8B for a first position of the mobile element.

FIG. 10 describes the transmission curve S21 designated as T(p1) and the reflection curve S11 designated as R(p1) of the filter, both measured in dB vs. frequency f in GHz, obtained with the plurality of second mobile elements in the first position p1. The filter obtained is a bandpass filter of central frequency fc1 of 11.63 GHz and of passband deltaf1.

Figure 11:
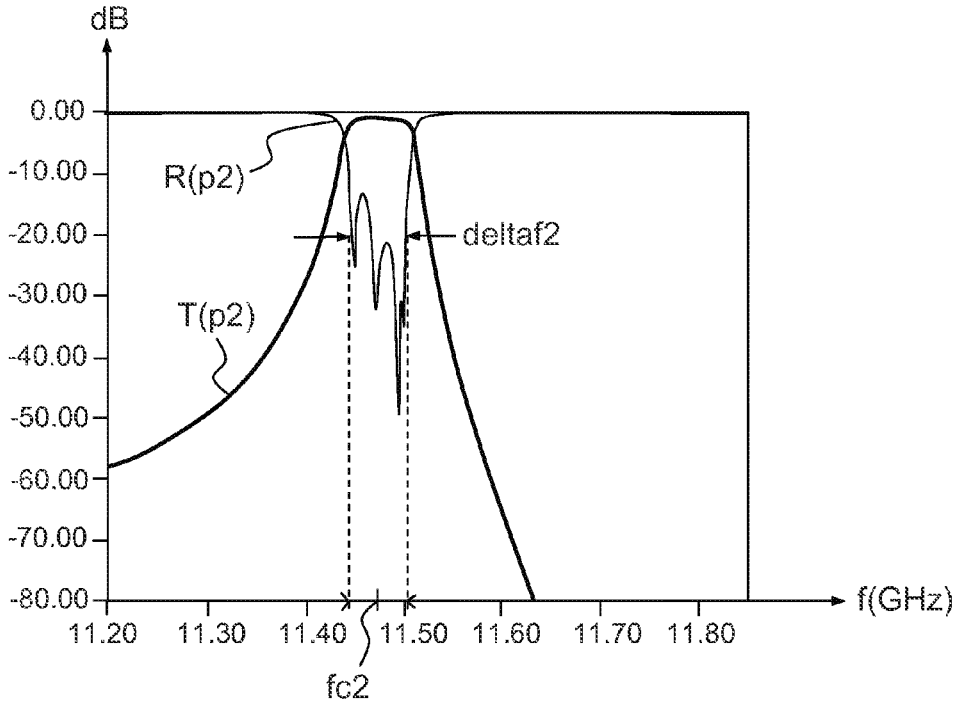
FIG. 11 represents the reflection and transmission curves of the filter described in FIGS. 9A and 9B for a second position of the mobile element.

FIG. 11 describes the transmission curve S21 designated as T(p2) and the reflection curve S11 designated as R(p2) of the filter, both measured in dB vs. frequency f in GHz, obtained with the plurality of second mobile elements in the second position p2. The filter obtained is a bandpass filter of central frequency fc2 of 11.46 GHz and of passband deltaf2.

Thus, by 90° rotation of the second element 802 of the four stacks, a channel hopping between a central frequency fc1 of 11.62 GHz and a central frequency fc2 of 11.7 GHz is obtained. The hop is 80 Mz.

In this example it has been sought to keep the passband identical for the two positions, so as to maintain the width of the channel without degrading the performance in terms of off-band attenuation of the signal.

But this example is not limiting. The invention also makes it possible to obtain a filter with channel hopping and passband variation simultaneously.

The resonant frequencies of the resonators are very dependent on temperature. To keep the characteristics (central frequency, passband etc.) of the filter stable with temperature, a variant of the invention is to slave the rotation of the mobile element or elements as a function of temperature. Thus the positions p1 and/or p2 are variable as a function of temperature so as to maintain the stable resonant frequencies as a function of temperature. The filter is thus slaved in terms of temperature.

The invention claimed is:

1. A frequency-tunable microwave-frequency wave filter with a dielectric resonator, the frequency-tunable microwave-frequency wave filter comprising:

a metallic cavity; and at least one stack of elements defining the dielectric resonator positioned along a rotation axis inside of the metallic cavity, wherein the at least one stack of elements includes at least a first element made of a first dielectric material and a second element made of at least one of the first dielectric material and a second dielectric material, wherein the second element rotates relative to the first element about the rotation axis between a first position and at least one second position, wherein the first position is separated from the at least one second position by an angle of rotation, wherein a first shape of an outside envelope of the at least one stack of elements as defined by an arrangement of the first element and the second element in the first position is different than a second shape of the outside envelope of the at least one stack of elements as defined by an arrangement of the first element and the second element in the at least one second position, wherein the second element is positioned in the first position and the frequency-tunable microwave-frequency wave filter defines a first resonator and exhibits a first central frequency, and wherein the second element is positioned in the at least one second position and the frequency-tunable microwave-frequency wave filter defines a second resonator and exhibits a second central frequency different than the first central frequency.

2. The frequency-tunable microwave-frequency wave filter according to claim 1, further comprising a rotation control means for controlling a rotation of the second element.

3. The frequency-tunable microwave-frequency wave filter according to claim 1, wherein the second element has a substantially plate shape in a plane perpendicular to the rotation axis.

4. The frequency-tunable microwave-frequency wave filter according to claim 1, wherein an axis of symmetry of the second element is disposed in a plane perpendicular to the rotation axis.

5. The frequency-tunable microwave-frequency wave filter according to claim 4, wherein the axis of symmetry intersects the rotation axis.

6. The frequency-tunable microwave-frequency wave filter according to claim 4, wherein the second element has a shape of an oval plate.

7. The frequency-tunable microwave-frequency wave filter according to claim 1, wherein the first element is substantially identical to the second element.

8. The frequency-tunable microwave-frequency wave filter according to claim 7, wherein the second element is positioned in the first position and the first element and the second element are exactly superimposed.

9. The frequency-tunable microwave-frequency wave filter according to claim 1, wherein the angle of rotation is substantially equal to 90°.

10. The frequency-tunable microwave-frequency wave filter according to claim 1, wherein the at least one stack of elements includes a third element that is substantially identical to the first element, wherein the first element and the third element are exactly superimposed, and wherein the second element is positioned between the first element and the third element.

11. The frequency-tunable microwave-frequency wave filter according to claim 1, wherein the second element is one of a plurality of movable elements that are substantially identical.

12. The frequency-tunable microwave-frequency wave filter according to claim 11, wherein each movable element of the plurality of movable elements rotates between a respective first position and a respective at least one second position.

13. The frequency-tunable microwave-frequency wave filter according to claim 12, wherein the respective first position of each of the mobile elements is a first same position, and wherein the respective at least one second position of each of the mobile elements is a second same position.

14. The frequency-tunable microwave-frequency wave filter according to claim 1, wherein the at least one stack of elements is one of a plurality of stacks of elements of the frequency-tunable microwave-frequency wave filter, wherein each of the plurality of stacks of elements is arranged about a respective one of a plurality of rotation axes wherein the plurality of stacks of elements define a plurality of first resonators coupled together such that the frequency-tunable microwave-frequency wave filter exhibits the first central frequency, and wherein the plurality of stacks of elements define a plurality of second resonators coupled together so that the said filter exhibits the second central frequency.

15. The frequency-tunable microwave-frequency wave filter according to claim 14, wherein the plurality of rotation axes are aligned in parallel.

16. The frequency-tunable microwave-frequency wave filter according to claim 14, wherein each of the of the plurality of stacks of elements is identical.

17. A microwave frequency circuit comprising at least one frequency-tunable microwave-frequency wave filter according to claim 1.

18. The frequency-tunable microwave-frequency wave filter according to claim 1, wherein the first position and/or the at least one second position are variable as a function of temperature so as to maintain respective values of the first central frequency and the second central frequency constant during a temperature variation.

19. The frequency-tunable microwave-frequency wave filter according to claim 1, wherein the frequency-tunable microwave-frequency wave filter changes at least one of the first position and the at least one second position as a function of temperature such that a value of the first central frequency and a value of the second central frequency remains constant during a temperature variation.

* * * * *